United States Patent [19]

Pelton

[11] 4,290,588

[45] Sep. 22, 1981

[54] APPARATUS FOR REFINING MOLTEN ALUMINUM

[75] Inventor: John F. Pelton, Yorktown Heights, N.Y.

[73] Assignee: Union Carbide Corporation, New York, N.Y.

[21] Appl. No.: 142,444

[22] Filed: Apr. 21, 1980

[51] Int. Cl.[3] ..... C22B 9/00

[52] U.S. Cl. ..... 266/225; 266/230; 266/235; 75/68 R; 75/93 E

[58] Field of Search ..... 266/225, 230, 235; 75/68 R, 93 E

[56] References Cited

U.S. PATENT DOCUMENTS 3,870,511 3/1975 Szekely ..... 75/68 R 4,024,056 5/1977 Yarwood et al. ..... 75/68 R

*Primary Examiner*—M. J. Andrews

*Attorney, Agent, or Firm*—Saul R. Bresch

[57] ABSTRACT

In an apparatus for refining molten metal comprising a vessel having an inlet compartment; first and second refining compartments, each having a rotating gas distributing device disposed therein; and an exit compartment, the improvement comprising providing an exit tube wherein (i) the top wall slants downward from inlet end to outlet end at an angle of about 5 to about 15 degrees from the horizontal and (ii) the ends of the exit tube are about flush with the baffle and the wall dividing the first refining compartment and the exit compartment.

5 Claims, 6 Drawing Figures

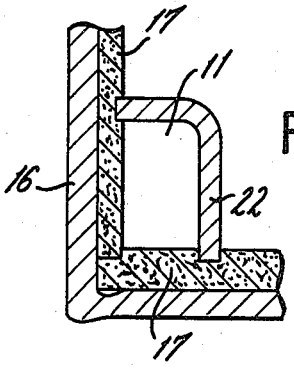
FIG. 3
FIG. 5
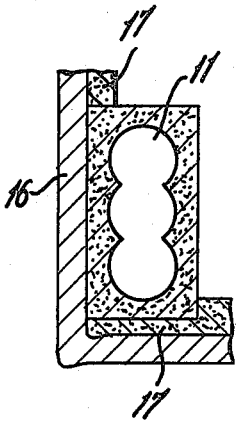
FIG. 4
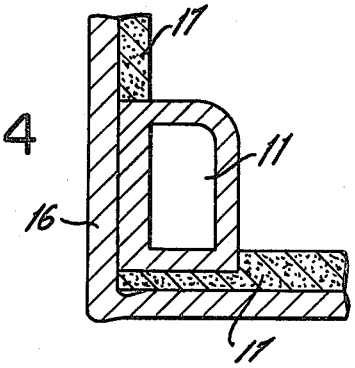
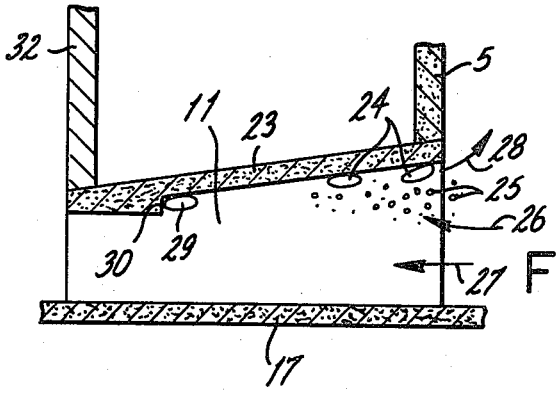
FIG. 6

APPARATUS FOR REFINING MOLTEN ALUMINUM

FIELD OF THE INVENTION

This invention relates to apparatus for refining molten metal.

DESCRIPTION OF THE PRIOR ART

Although the invention described herein has general application in refining molten metals, it is particularly relevant in refining aluminum, magnesium, copper, zinc, tin, lead, and their alloys and is considered to be an improvement over the apparatus described in U.S. Pat. No. 3,743,263 issued July 3, 1973, which is incorporated by reference herein.

Basically, the process carried out in the reference apparatus involves the dispersion of a sparging gas in the form of extremely small gas bubbles throughout a melt. Hydrogen is removed from the melt by desorption into the gas bubbles, while solid non-metallic impurities are lifted into a dross layer by flotation. The dispersion of the sparging gas is accomplished by the use of rotating gas distributors, which produce a high amout of turbulence within the melt. The turbulence causes the small non-metallic particles to agglomerate into large particle aggregates which are floated to the melt surface by the gas bubbles. This turbulence in the metal also assures thorough mixing of the sparging gas with the melt and keeps the interior of the vessel free from deposits and oxide buildups. Non-metallic impurities floated out of the metal are withdrawn from the system with the dross while the hydrogen desorbed from the metal leaves the system with the spent sparging gas.

The system in which this process is carried out and which is of interest here is one in which the metal to be refined flows through an entrance compartment into a first refining compartment, over a baffle, and into a second refining compartment, each of the compartments having its own rotating gas distributor. The molten metal then enters an exit tube and passes into an exit compartment, which for the sake of efficient utilization of space is along side of the entrance compartment at the same end of the refining apparatus. See FIGS. 4 and 5 of U.S. Pat. No. 3,743,263, mentioned above. The compact nature of this arrangement results, advantageously, in a relatively small sized piece of equipment.

While the compact system has performed, and continues to perform, well in service, it has a maximum refining capacity of 60,000 pounds of metal per hour. Many aluminum plants, however, have a need for an even higher refining rate, but do not have the space to accommodate a scale-up of the existing system, e.g., a three refining compartment/three rotating gas distributor system, which, to add to the difficulty, cannot use the same one-sided entrance-exit configuration.

SUMMARY OF THE INVENTION

An object of this invention, therefore, is to provide an improvement in the existing compact refining apparatus which is capable of increasing the refining capacity of the apparatus without increasing its bulk.

Other objects and advantages will become apparent hereinafter.

According to the present invention, such an improvement has been discovered in known apparatus for refining molten metal comprising, in combination:

(a) a vessel having four compartments: an an inlet compartment, first and second refining compartments separated by a baffle, and an exit compartment separated from the first refining compartment by a common wall, the last three compartments sharing a common bottom surface, wherein (i) the inlet compartment provides a passageway for the molten metal running from the outside of the vessel to the top section of the first refining compartment; (ii) except as provided in (iii), the baffle is constructed in such a manner that it only permits the passage of molten metal over the top of the baffle; (iii) the bottom section of the second compartment is connected to the exit compartment by an exit tube having an opening on each end, a top wall, two side walls and a bottom wall, said exit tube (1) passing through the baffle and the first refining compartment; (2) having its bottom wall residing on the common surface; and (3) having its inlet end opening into the second refining compartment and its outlet end opening into the exit compartment; and (iv) the exit compartment provides a passageway to the outside of the vessel;

(b) one rotating gas distributing device disposed at about the center of each refining compartment, said device comprising a shaft having drive means at it upper end and a rotor fixedly attached to its lower end, the upper end being positioned in the top section of the compartment and the lower end being positioned in the bottom section of the compartment.

The improvement comprises providing an exit tube wherein (i) the top wall slants downward from inlet end to outlet end at an angle of about 5 to about 15 degrees from the horizontal and (ii) the ends of the exit tube are about flush with the baffle and the wall dividing the first refining compartment and the exit compartment.

BRIEF DESCRIPTION OF THE DRAWING

FIG. 3 is a schematic diagram of a partial front view in section of an embodiment showing an example of exit tube construction.

FIG. 4 is a schematic diagram of a partial front view in section of an embodiment showing another example of exit tube construction.

FIG. 5 is a schematic diagram of a partial front view in section of an embodiment showing another example of exit tube construction.

FIG. 6 is a schematic diagram of a partial side elevation of an embodiment showing exit tube, baffle, and bubble pattern.

DESCRIPTION OF THE PREFERRED EMBODIMENT

Figure 1:
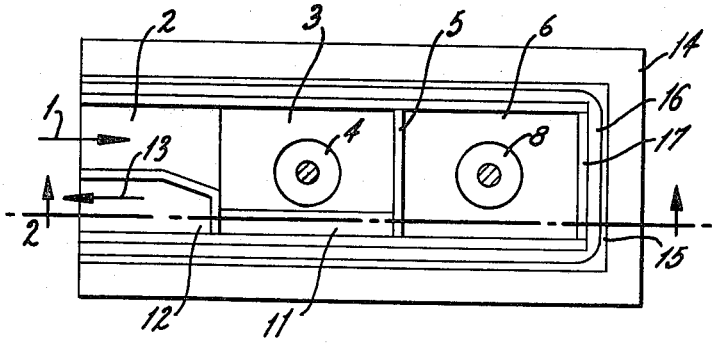
FIG. 1 is a schematic diagram of a plan view of an embodiment of subject apparatus.

The first step in achieving the defined improvement was to make a determination as to what limited the refining capacity of the known compact apparatus. It was found that the limitation was caused by the allowable head drop of the liquid metal in passing through the system. The "head drop" is the difference between the higher level at which the liquid metal enters the system at the inlet trough and the lower level at which the melt leaves the system at the exit trough. At the maximum capacity of 60,000 pounds per hour, this head drop is about 2 to about 3 inches. The configuration of the compact apparatus makes it difficult, if not impossible, to operate at or above this maximum capacity with any larger head drop. The drop in metal level in the exit trough due to greater head drop results in higher flow velocities, which increase the chance of mixing floating dross with the refined metal stream. Further increases in exit flow velocities, resulting from higher metal flow rates, add to the chances of dross mixing. Higher metal flow rates also increase the fluid friction, primarily in the exit tube, which, in turn, results in additional head drop. Further, higher metal flow rates require higher speeds of rotation for the gas distributor and higher gas sparging (flow) rates to achieve the same degree of refining capacity and these rotating speeds and sparging rates also increase the head drop. Thus, the solution to the problem appeared to lie in finding a way to limit the head drop and, in so doing, overcome any negative factors arising therefrom.

Figure 2:
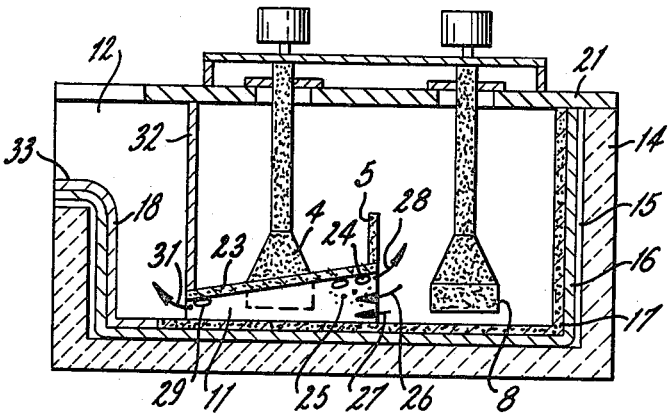
FIG. 2 is a schematic diagram of a side elevation of the same embodiment of subject apparatus taken along line 2—2 of FIG. 1.

Referring to the drawing:

Considering FIGS. 1 and 2, the molten metal flows in the direction of arrow 1 into inlet compartment 2 and then passes into the first refining compartment 3 where it encounters rotating gas distributor 4. The inlet compartment differs from the other compartments in that it is more of a zone than a distinct entity. In actuality, it is an extension of the inlet trough or lip inclining into first refining compartment 3 somewhat like a chute forming, as noted, a passageway for the melt from the outside of the apparatus to the top section of refining compartment 3. The melt then passes from compartment 3 over baffle 5 into second refining compartment 6 to meet rotating gas distributor 8 and proceeds through graphite exit tube 11 into exit compartment 12, exiting in the direction of arrow 13. The dross, which has floated to the surface, is carried to inlet compartment 2 counter to arrow 1 and is skimmed off. Surrounding the compartments are, from the outside in, a vessel in the shape of a rectangular prism having an outer wall 14 made of metal with refractory insulation, heating elements (not shown) in chamber 15, cast iron shell 16, graphite plates 17 as the lining for the greater part of the refining compartments and part of the inlet and exit compartments, silicon carbide or zircon shapes 18 as a lining for the balance of the inlet and exit compartments, and silicon carbide plate 32, which serves as a common wall between first refining compartment 3 and exit compartment 12. The common bottom surface shared by refining compartments 3 and 6 and exit compartment 12 is shown as one of graphite plates 17, but can be two or more plates joined together to provide the common surface. Shape 18 provides a lip 33, which is the bottom of the exit trough. There is a similar lip at the inlet compartment (not shown), which is the bottom of the inlet trough. The lips or trough bottoms indicate the lowest level at which the melt can enter inlet compartment 2 and leave exit compartment 12. The enclosure is completed with cover 21.

With the exception of exit tube 11 and baffle 5, the heretofore described apparatus illustrates the conventional compact rotating gas distributor refining system. As noted above, the improvement lies in providing an exit tube of a particular construction in combination with the conventional apparatus and, preferably, with the known, but not commonly used, higher baffle, the top of which is just below the surface of the melt, i.e., at a point where the melt can pass freely from one compartment to the other thereover during idle. The height of the baffle is explained more fully below.

It will be observed from the drawing that exit tube 11 begins at baffle 5 and continues through to exit compartment 12. Preferably, there is no overlap of exit tube 11 into refining compartment 6 or into exit compartment 12. Thus, the inlet and outlet ends of exit tube 11 are flush with baffle 5 and silicon carbide plate 32 common to refining compartment 3 and exit compartment 12. The exit tube is typically a hollow tube open at each end and considered to be divided into quadrants, i.e., a top wall, two parallel side walls, and a horizontal bottom wall. As noted, the top wall of the exit tube slants downward from inlet end to outlet end at an angle of about 5 to about 15 degrees from the horizontal and preferably at an angle of about 7 to about 10 degrees from the horizontal, the horizontal being, of course, an imaginary line perpendicular to the direction of the force of gravity.

The maximum width of exit tube 11 is limited by the radius of the rotor, which, of course, must be able to spin freely. To minimize head drop, it would seem that the width should be as wide as possible, subject to this limitation; however, the more space taken up in the refining zone by the exit tube, the higher the rotor speed required to produce the same refining effect, and the smaller the clearance between exit tube and rotor, the greater the chance that hard chunks of foreign material will get caught and break the rotor shaft. FIGS. 3, 4, and 5 illustrate three types of construction, which maximize cross-section and yet minimize the space and clearance problem. In FIG. 3, a curved refractory piece is fitted and cemented into grooves in side and bottom walls 17, the walls of the apparatus being utilized as exit tube walls. Piece 22 provides the top wall and one side wall for exit tube 11. Instead of having a square corner at the junction of the top wall and side wall, the corner of the piece is rounded or beveled so as not to impede the flow of the melt in the compartment. FIGS. 4 and 5 are similar to FIG. 3 except that exit tube 11 is a monolith which is accommodated by removing parts of graphite side wall and bottom wall 17 and cementing exit tube 11 into place. The FIG. 4 design is preferred, but, where graphite is the material of choice, the FIG. 5 design is the simplest to make because it can be machined. As a rule of thumb, the width of the exit tube can be at least about one half to about three quarters of the distance from wall 17 to the outer periphery of the rotor. Further, the configuration of exit tube 11 and baffle 5 must be such that there are no other openings in baffle 5 (except, of course, at the top of the baffle) or common silicon carbide plate 32. As in FIGS. 3, 4, and 5 the preferred location of exit tube 11 is at the junction of the side and bottom walls. It will be understood that the passage through the exit tube is a straight, gradually declining one of uniform width with the slant being in the top wall, subject to the modification of FIG. 6 discussed below.

The flow pattern in two versions of exit tube 11 is found in FIGS. 2 and 6. In both Figures, the liquid flows through exit tube 11 in the direction of arrow 27. Small bubbles 25 that are forced into exit tube 11 by the action of the rotating gas distributor follow an upward curved path as shown by arrow 26. These small bubbles collect and coalesce into larger bubbles 24 on the inner surface of top wall 23 and are then carried out of the inlet opening of exit tube 11 along the path of arrow 28 by their buoyant force acting against the slanting top surface of exit tube 11. In some cases, greater action of the rotating gas distributor is desired, and the higher level of turbulence caused by this action may cause some large bubbles 29 to enter the exit chamber as shown by arrow 31. Bubbles in the exit compartment are undesirable because they rise to the surface and produce a surface turbulence, which can entrain floating dross or oxide skins into the metal stream, thus defeating one of the purposes of the refining system, i.e., the removal of solid inclusions. While the invention as described heretofore removes the small bubbles at both normal and higher operating conditions and the larger bubbles at normal operating conditions, to insure the removal of large bubbles 29 at higher rotating gas distributor speeds a small step down 30 or ledge is provided in top wall 23 near the exit end of exit tube 11. Now, large bubbles that may start toward the exit compartment are held momentarily by step down 30. When the turbulence momentarily decreases at the entrance to exit tube 11 due to the constantly changing flow patterns within refining zone 6, large bubbles 29 are discharged out of the inlet end of exit tube 11 following arrow 28 just as large bubbles 24.

Baffle 5 is preferably made as high as possible consistent with being able to skim off the dross layer from the entrance in inlet compartment 2. In normal use, when the system is in an idle condition, i.e., not refining, the liquid level is reduced to the lip of the inlet or exit compartment, whichever is lower. The top of the baffle is located slightly below this level, e.g., about 1.5 inches, so that it does not obstruct the free movement of dross from the second refining zone toward the inlet.

It is found that subject apparatus can not only be used to increase the flow rate of the melt through the system, but can be used to provide a greater degree of refining by increasing the rotating speed of the spinning nozzles and the gas flows at the conventional flow rate. Further, any number of combinations of flow rate, speed of rotation, and gas flow are possible before the maximum allowable head drop is attained.

I claim:

1. In an apparatus for refining molten metal comprising, in combination:

(a) a vessel having four compartments: an inlet compartment, first and second refining compartments separated by a baffle, and an exit compartment separated from the first refining compartment by a common wall, the last three compartments sharing a common bottom surface, wherein (i) the inlet compartment provides a passageway for the molten metal running from the outside of the vessel to the top section of the first refining compartment; (ii) except as provided in (iii), the baffle is constructed in such a manner that it only permits the passage of molten metal over the top of the baffle, (iii) the bottom section of the second compartment is connected to the exit compartment by an exit tube having an opening on each end, a top wall, two side walls and a bottom wall, said exit tube (1) passing through the baffle and the first refining compartment, (2) having its bottom wall residing on the common bottom surface; and (3) having its inlet end opening into the second refining compartment and its outlet end opening into the exit compartment; and (iv) the exit compartment provides a passageway to the outside of the vessel;

(b) one rotating gas distributing device disposed at about the center of each refining compartment, said device comprising a shaft having drive means at its upper end and a rotor fixedly attached to its lower end, the upper end being positioned in the top section of the compartment and the lower end being positioned in the bottom section of the compartment, the improvement comprising providing an exit tube wherein (i) the top wall slants downward from inlet end to outlet end at an angle of about 5 to about 15 degrees from the horizontal and (ii) the ends of the exit tube are about flush with the baffle and the wall dividing the first refining compartment and the exit compartment.

2. The apparatus defined in claim 1 wherein the angle is about 7 to about 10 degrees.

3. The apparatus defined in claim 1 wherein the junction of the top wall and the sidewall facing the rotor is rounded or beveled.

4. The apparatus defined in claim 1 wherein there is a step-down in a section of the top wall near to the outlet end, the step-down being of sufficient size to trap large bubbles.

5. The apparatus defined in claim 3 wherein the exit tube is a monolith partially embedded in the walls of the first refining compartment.

* * * * *